US006478557B2

(12) United States Patent
Shiibayashi et al.

(10) Patent No.: US 6,478,557 B2
(45) Date of Patent: Nov. 12, 2002

(54) SCROLL COMPRESSOR SUITABLE FOR A LOW OPERATING PRESSURE RATIO

(75) Inventors: Masao Shiibayashi; Yasushi Izunaga; Katsuaki Yano, all of Shimizu (JP)

(73) Assignee: Hitachi, Ltd., Tokyo (JP); Trustee for the Benefit of Hitachi Air Conditioning Systems, Co. Ltd.

( * ) Notice: Subject to any disclaimer, the term of this patent is extended or adjusted under 35 U.S.C. 154(b) by 0 days.

(21) Appl. No.: 09/848,442

(22) Filed: May 4, 2001

(65) Prior Publication Data

US 2002/0051719 A1 May 2, 2002

(30) Foreign Application Priority Data

Sep. 20, 2000 (JP) ..... 2000-284922

(51) Int. Cl.[7] ..... F04C 18/04; F04C 29/02
(52) U.S. Cl. ..... 418/55.2; 418/55.5; 418/55.6
(58) Field of Search ..... 418/55.2, 55.5, 418/55.6, 57

(56) References Cited

FOREIGN PATENT DOCUMENTS

| | | | | |
|---|---|---|---|---|
| JP | 59-23095 | * | 2/1984 | ..... 418/55.2 |
| JP | 61-187584 | * | 8/1986 | |
| JP | 3-236546 | * | 10/1991 | |
| JP | 3-271583 | * | 12/1991 | |
| JP | 6-117382 | * | 4/1994 | ..... 418/55.6 |
| JP | 8-210279 | * | 8/1996 | |
| JP | 10-169574 | * | 6/1998 | |

* cited by examiner

*Primary Examiner*—John J. Vrablik
(74) *Attorney, Agent, or Firm*—Antonelli, Terry, Stout & Krasu, LLP

(57) ABSTRACT

A scroll compressor using helium gas as working gas, has a fixed scroll and an orbiting scroll, engaged with each other, each having a scroll tooth profile shape of a set volume ratio of a scroll wrap portion of 1.8 to 2.3. The set volume ratio of a scroll wrap portion is defined by the following expression:

$$Vr = \frac{2\lambda_1 - 4\pi + \alpha}{2\lambda_s + 2\pi + \alpha}$$

where Vr: set volume ratio of a scroll wrap portion, $\lambda_1$: an angle at a wrap winding end portion (Involute angle), $\lambda_s$: an angle at a wrap winding start portion (Involute angle), $\pi$: circle ratio, $\alpha$: ratio of an orbiting radius ($\epsilon_{th}$) to a base circle radius (a) of the scroll wrap ($\epsilon_{th}$/a)

7 Claims, 16 Drawing Sheets

SCROLL COMPRESSOR SUITABLE FOR A LOW OPERATING PRESSURE RATIO

BACKGROUND OF THE INVENTION

The present invention relates to a hermetic scroll compressor using helium gas as a working gas and for use in a helium compressor for a cryopump device in an extreme high vacuum field.

A conventional hermetic scroll compressor in which cooling is effected by oil, that is, an oil injection type hermetic scroll compressor is disclosed in, for example, JP-A-61-187584 specification. In such conventional hermetic scroll compressor, an oil separator is provided midway in a discharge pipe, and oil separated from gas at the oil separator is injected into a compressor section, and oil within a hermetic container is also injected into the compressor section. Further, an example of an oil injection type scroll compressor for a helium liquefied refrigerating apparatus is disclosed in JP-A-3-271583 specification. In the above-described scroll compressors, a number of turns of scroll wrap has been set to be as comparatively large as 2.7 to around 4.

Recently, when a compressor is used for helium application, need for an operation within a hitherto unknown, exceedingly low operating pressure ratio range (operating pressure ratio is discharge pressure/suction pressure), for example, a range of around 1.5 to around 2 has been increased. In conventional compressors for cryopump apparatus in the above-described oil injection type conventional compressors, however, an operating pressure ratio is around 2.5 to around 7, and therefore, any normal operation cannot be secured in such exceedingly low operating pressure ratio range. In other words, in the case of low operating pressure ratio of around 1.5 to around 2 as described above, a problem arises that excessive compression power loss of the compressor generally becomes high and efficiency reduction becomes remarkable.

Further, in the conventional compressors, since an amount of displacement of an orbiting scroll in an axial direction is increased by an increase in gas pressure in a compression chamber, the orbiting motion may become unstable, causing galling or the like due to contact between wraps. Since when helium gas is used as working gas, it has a higher ratio of specific heat than other refrigerant gas (for example, freon gas for refrigeration and air conditioning), an internal compression power also becomes greater, and discharge gas temperature becomes higher, and therefore, it is necessary to strengthen cooling of the helium gas.

BRIEF SUMMARY OF THE INVENTION

It is an object of the present invention to provide a scroll compressor capable of performing a stable operation without lowering the efficiency even within an exceedingly low operating pressure ratio range.

In order to attain the above-described object, a scroll compressor using helium gas as working gas according to the present invention, comprises a fixed scroll and an orbiting scroll, engaged with each other, each having a scroll tooth profile shape of a set volume ratio of a scroll wrap portion of 1.8 to 2.3, said set volume ratio being defined by the following expression;

$$Vr = \frac{2\lambda_1 - 4\pi + \alpha}{2\lambda_s + 2\pi + \alpha} \tag{1}$$

where

Vr: set volume ratio of a scroll wrap portion, $\lambda_1$: an angle at a wrap winding end portion (Involute angle), $\lambda_s$: an angle at a wrap winding start portion (Involute angle), $\pi$: circle ratio, $\alpha$: ratio of an orbiting radius $\epsilon_{th}$ to a base circle radius a of the scroll wrap ($=\epsilon_{th}/a$).

The set volume ratio of a scroll wrap portion=volume of maximum closed space formed by scroll wraps/volume of minimum closed space formed by scroll wraps.

FIG. 17 shows variations in overall adiabatic efficiency with respect to an operating pressure ratio when the set volume ratio of a scroll wrap portion Vr is changed. When the set volume ratio of a scroll wrap portion Vr is 1.8 to 2.3, the overall adiabatic efficiency of the present invention increases over ten percent to over twenty percent in terms of the operating pressure ratio than a conventional compressor (of which set volume ration Vr is 2.7, for example). Particularly, the scroll compressor using helium gas is frequently operated at an extremely low operating pressure ratio, but according to the above-described structure, the overall adiabatic efficiency increases at the exceedingly low operating pressure ratio and a high-performance scroll compressor can be obtained.

The scroll wrap portion is formed of a casting material, and at least one of a scroll wrap winding start portion and a scroll wrap winding end portion can be provided with a step.

Further, it is preferable to set the set volume ratio Vr to 2.1. A reason why the set volume ratio Vr is set to 2.1 is that, as can be appreciated from FIG. 17, there is an effect of improving the performance at the low operating pressure ratio range while the performance reduction at the high operating pressure ratio range (around 5) is comparatively low.

Also, when tip ends of the scroll wrap portion are rounded with a radius larger than a half of an average thickness of the scroll wrap portion, the strength of the scroll wrap can be improved.

Also, the fixed scroll is fixed to a frame provided on a back surface side of the orbiting scroll. A back pressure chamber is formed by the frame and a back surface of an end plate of the orbiting scroll. An oil filler port, through which oil for cooling the helium gas is injected into a compression chamber formed by the fixed scroll and the orbiting scroll, is provided on an end plate of the fixed scroll. A thin hole, through which a part of the helium gas halfway of compression stroke within the compression chamber is introduced into the back pressure chamber, is formed on the end plate of the orbiting scroll. A ratio Pb/Ps of the pressure Pb within the back pressure chamber with respect to a suction pressure Ps is set to around 1.5.

Also, in the present invention, a lower limit of the operating pressure ratio $(Pd/Ps)_{min}$ and a set intermediate pressure ratio $(Pb/Ps)_m$ satisfy a relationship of $(Pd/Ps)_{min} \equiv (Pb/Ps)_m + 0.2$.

Further, a compressor of the present invention is characterized in that it is applied to a helium refrigerating apparatus and it is operated at a condition in which an operating pressure ratio of is around 1.5 to around 5 and an upper limit of the suction pressure is set on a lower limit of the operating pressure ratio.

In addition, with the aim of enhancing the performance at a low operating pressure ratio range of around 1.5 to around 2, the present invention is characterized by having a fixed scroll and an orbiting scroll, engaged with each other, each having a scroll tooth profile shape of a set volume ratio Vr of a scroll wrap portion of 1.8 to 2.0.

DETAILED DESCRIPTION OF THE INVENTION

Hereinafter, with reference to the drawings, the embodiments of the present invention will be described.

Figure 1:
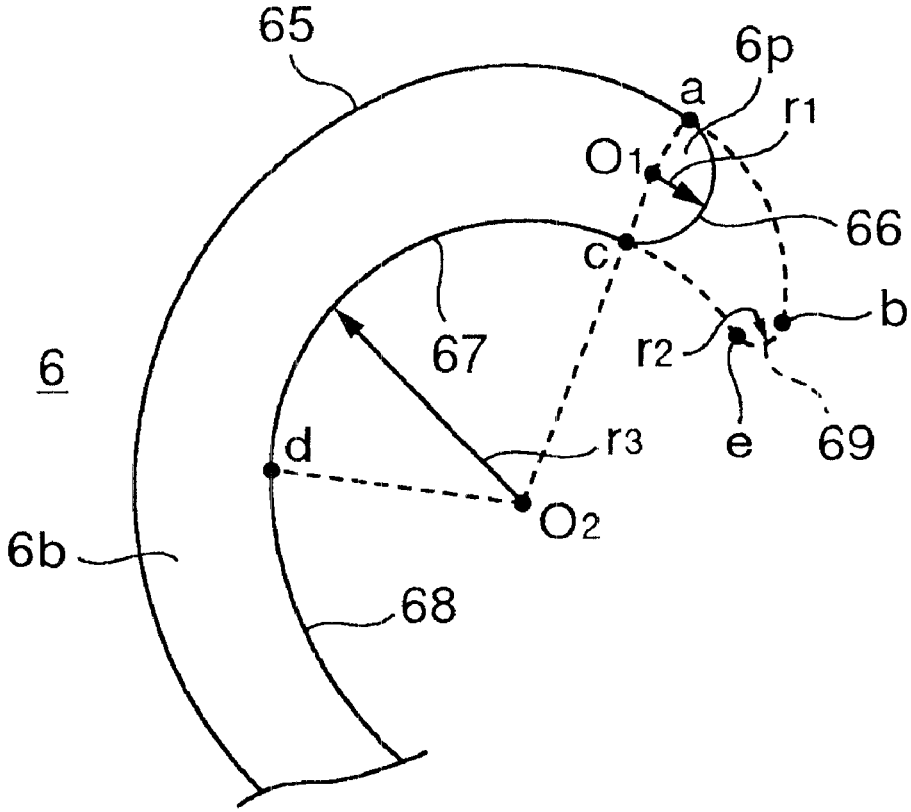
FIG. 1 is a view showing a tip end portion of a wrap of an orbiting scroll of a scroll compressor according to the present invention.
Figure 2:
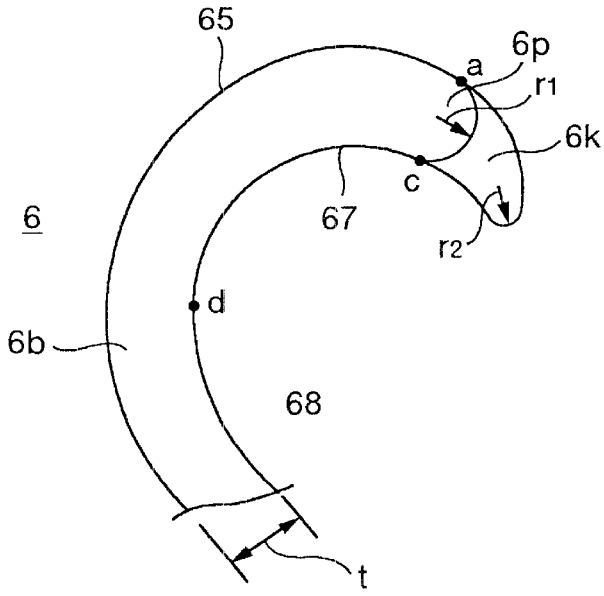
FIG. 2 is a view showing a variation of the wrap tip end portion of the orbiting scroll.
Figure 3:
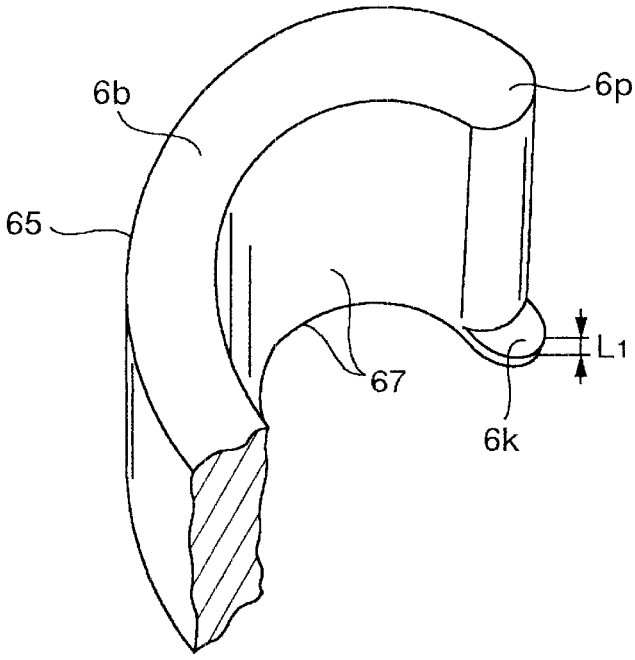
FIG. 3 is a perspective view showing the wrap tip end portion shown in FIG. 2.

FIGS. 1 to 3 show shapes of a tip end portion of an orbiting scroll of a scroll compressor according to the present invention. FIGS. 2 and 3 show an example in which a scroll wrap portion for an air conditioner having a set volume ratio Vr of, for example, around 2.7 is applied to a scroll wrap portion for helium application in order to improve the mass producibility and productivity of the scroll compressor. The scroll wrap portion for an air conditioner is generally formed of casting material, and in this example, a step-shaped scroll wrap portion with a part of the scroll wrap winding start portion left behind is formed of casting material, and is made into an adequate scroll wrap shape as helium application.

When a set volume ratio Vr of the scroll wrap portion is set to 1.8 to 2.3, the scroll compressor is able to ensure a stable operation without lowering the efficiency even in an exceedingly low operating pressure ratio range. The orbiting scrolls shown in FIGS. 1 to 3 have a scroll tooth profile shape having the set volume ratio Vr of the scroll wrap portion of 2.1. Also, fixed scrolls engaging with these orbiting scrolls have also the scroll tooth profile shape having the set volume ratio Vr of the scroll wrap portion of 2.1.

Vr is expressed by the following expression:

$$Vr = \frac{2\lambda_1 - 4\pi + \alpha}{2\lambda_s + 2\pi + \alpha} \tag{2}$$

where $\lambda_1$: wrap winding end angle (Involute angle), $\lambda_s$: wrap winding start angle (Involute angle), $\pi$: circle ratio, $\alpha$: ratio of an orbiting radius $\epsilon_{th}$ to a base circle radius a of the scroll wrap ($=\epsilon_{th}/a$).

In FIG. 1, reference numeral 65 denotes an involute curve, and a point (a) is a starting point ($\lambda_s$=2.53 radian). A curve 67 for connecting a point (d) to a point (c) is an inside circular arc curve (of which center is at a point ($O_2$) and radius is $r_3$), and the point (c) of the tip end portion is connected to a point (a) through a smooth circular arc curve 66 (of which center is at a point ($O_1$) and radius is $r_1$). A portion enclosed with the circular arc curve 66 is a central tip end portion 6*p* of the wrap. A curve 68 on the outside of the point (d) is also an involute curve. In FIG. 1, a portion indicated by a broken line shows a scroll tooth profile shape having a set volume ratio Vr of the scroll wrap portion for an air conditioner of, for example, 2.7. In this scroll tooth profile shape, points (b) and (e) at a tip end portion are connected through a smooth circular arc curve 69 (of which radius is $r_2$). Also, the radius $r_3$ of the inside circular arc curve 67 has a value of a half a tooth space width (Dt in FIG. 4). In this respect, the tooth space width Dt is given by the following expression:

$$Dt=2\times\epsilon_{th}+t \tag{3}$$

where t: thickness of the wrap, $\epsilon_{th}$: an orbiting radius.

For example, if it is assumed that the thickness of the wrap (t) is 4.5 mm and the orbiting radius ($\epsilon_{th}$) is 6.5 mm, the tooth space width (Dt) becomes 17.5 mm, and thus, the radius ($r_3$) of the inside circular arc curve 67 becomes 8.75 mm. On the other hand, the radius ($r_1$) of the circular arc curve 66 is set to 2.43 mm, which is larger than a half (2.25 mm) of the thickness of the wrap (4.5 mm). In other words, the tip end of the wrap is rounded with a radius larger than a half of the wrap thickness. With this structure, concentration of stress due to gas pressure load is relieved and it is possible to strengthen the wrap. This is the same to the case of a wrap 5*b* of the fixed scroll 5 shown in FIG. 8.

Also, in FIGS. 2 and 3, reference character 6*k* denotes a step obtained by cutting an upper portion of a region, which is a wrap tip end portion for an air conditioner on the scroll wrap winding start side, leaving only its wrap root portion behind. Height $L_1$ of this step 6*k* is, for example, around 1 mm. A central tip end portion 6*p* except for the step 6*k* has the same structure as in the case of FIG. 1.

Even in such structure, the machining precision of the central tip end portion 6*p* is relieved, whereby it is possible to improve the machinability (productivity) and the strength of the wrap of the central tip end portion 6*p*.

Figure 4:
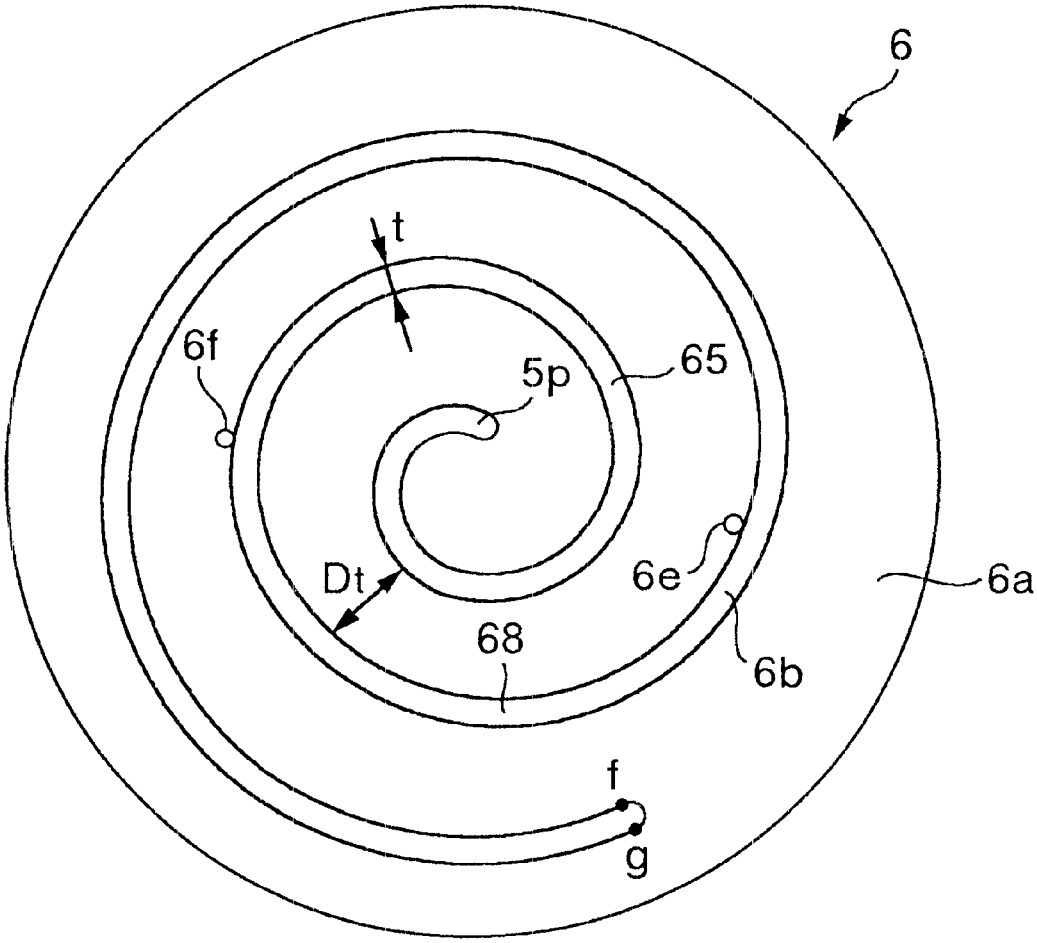
FIG. 4 is a plan view showing an orbiting scroll with thin holes provided.
Figure 5:
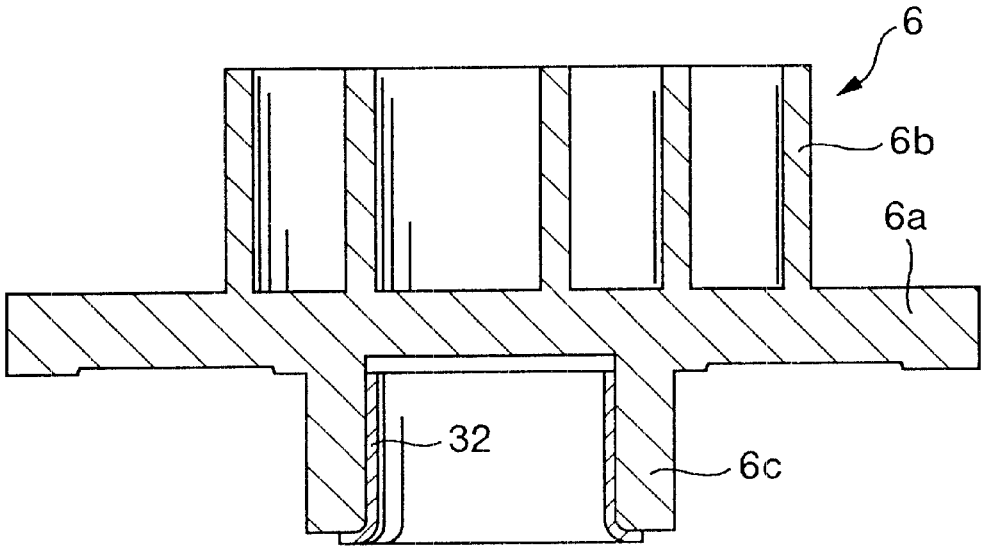
FIG. 5 is a vertical sectional view showing the orbiting scroll shown in FIG. 4.

FIG. 4 is a plan view showing the orbiting scroll, and FIG. 5 is a vertical sectional view of the orbiting scroll. The orbiting scroll shown in FIGS. 4 and 5 has a tip end portion formed in the scroll tooth profile shape shown in FIG. 1 or FIGS. 2 and 3. As shown in FIG. 4, the orbiting scroll 6 has a disk-shaped end plate 6*a,* and a vortex-shaped wrap 6*b* is formed on the end plate 6*a*. Points (f) and (g) are points in a wrap winding end portion. Converting into an angle, for example, an involute angle $\lambda_1$ becomes 19.3 radian. In this respect, the wrap winding start angle $\lambda_s$ of the Vr=2.1 specification wrap is 2.53 radian, and on the other hand, when a set volume ratio Vr is 2.7, the wrap winding start angle $\lambda_s$ becomes 1 radian at a position of the point (b) in FIG. 1. When the set volume ratio Vr is 2.7, a radius $r_2$ of the circular arc curve 69 obtained by smoothly connecting the outside curve to the inside curve at the tip end of the wrap central portion becomes around 0.3 mm to around 0.5 mm.

Figure 12:
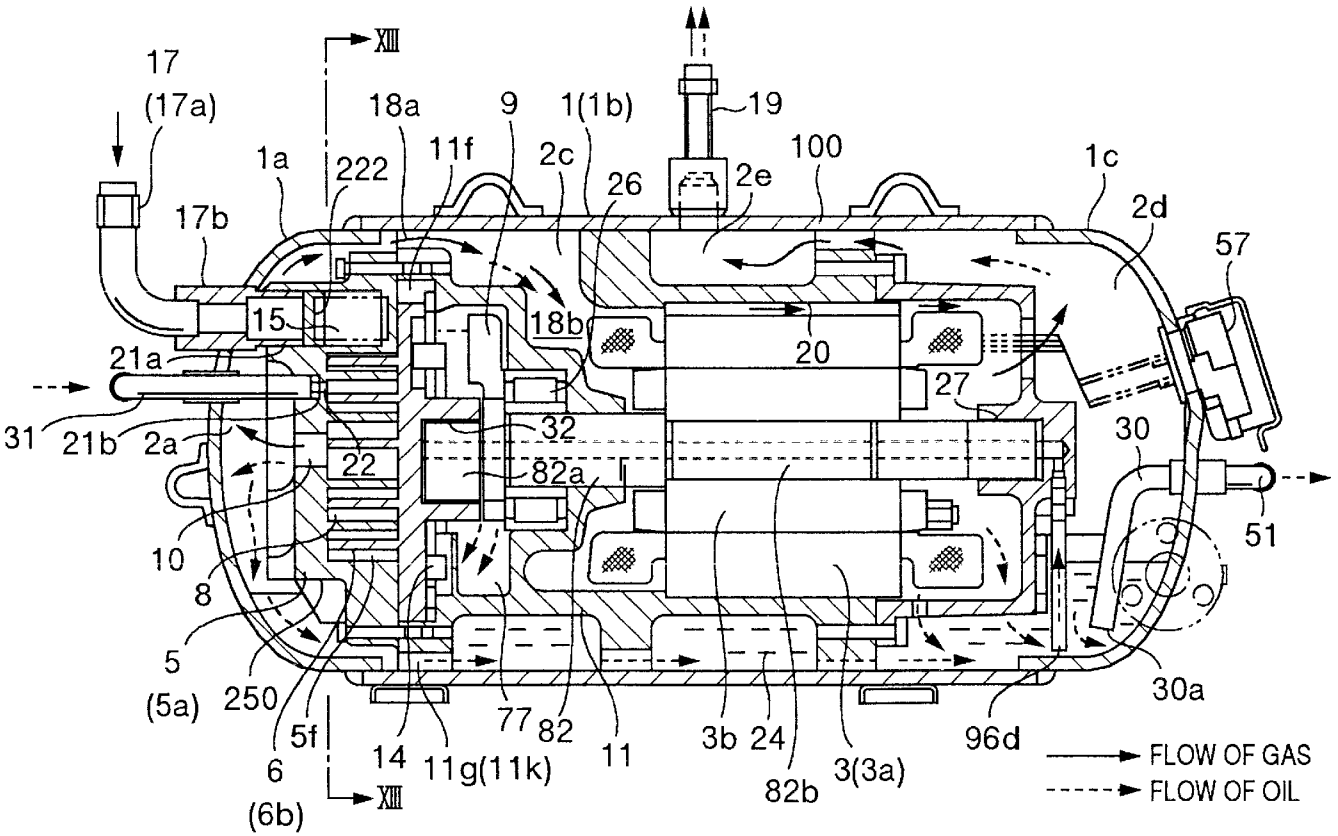
FIG. 12 is a vertical sectional view showing an oil injection type hermetic scroll compressor.

Also, the end plate 6*a* of the orbiting scroll 6 is provided with thin holes 6*e* and 6*f*. These thin holes 6*e* and 6*f* are used to introduce a part of gas halfway in compression stroke from a compression chamber into a back pressure chamber on a back surface of the orbiting scroll. More specifically, as the overall structure of the compressor, as shown in FIG. 12, the fixed scroll 5 is fixed to a frame 11, and further the orbiting scroll 6 is engaged with the fixed scroll 5. Thus, the part of gas halfway in the compression stroke is introduced into the back pressure chamber 77 formed by the end plate 6*a* of the orbiting scroll 6 and the frame 11 from a compression chamber 8 formed by the fixed scroll 5 and the orbiting scroll 6 through the thin holes 6*e* and 6*f*. In the figure, a reference character 6*c* denotes a boss portion provided on a surface of the end plate 6*a* opposite the wrap, and an orbiting bearing 32 (See FIG. 12) is fitted in the boss portion 6*c*.

Since back pressure within the back pressure chamber 77 becomes lower when such thin holes 6*e* and 6*f* are provided, a pressing force of the scroll wrap in the axial direction is reduced to enable sliding loss to be reduced, and it is possible to improve the performance of the compressor on a low operating pressure ratio.

In this respect, if the scroll tooth profile shape of the wrap 6*b* is set in advance in such a manner that the set volume ratio Vr of the scroll wrap portion becomes 1.8 to 2.3, the object of the present invention can be achieved without thin holes 6*e* and 6*f*.

Figure 6:
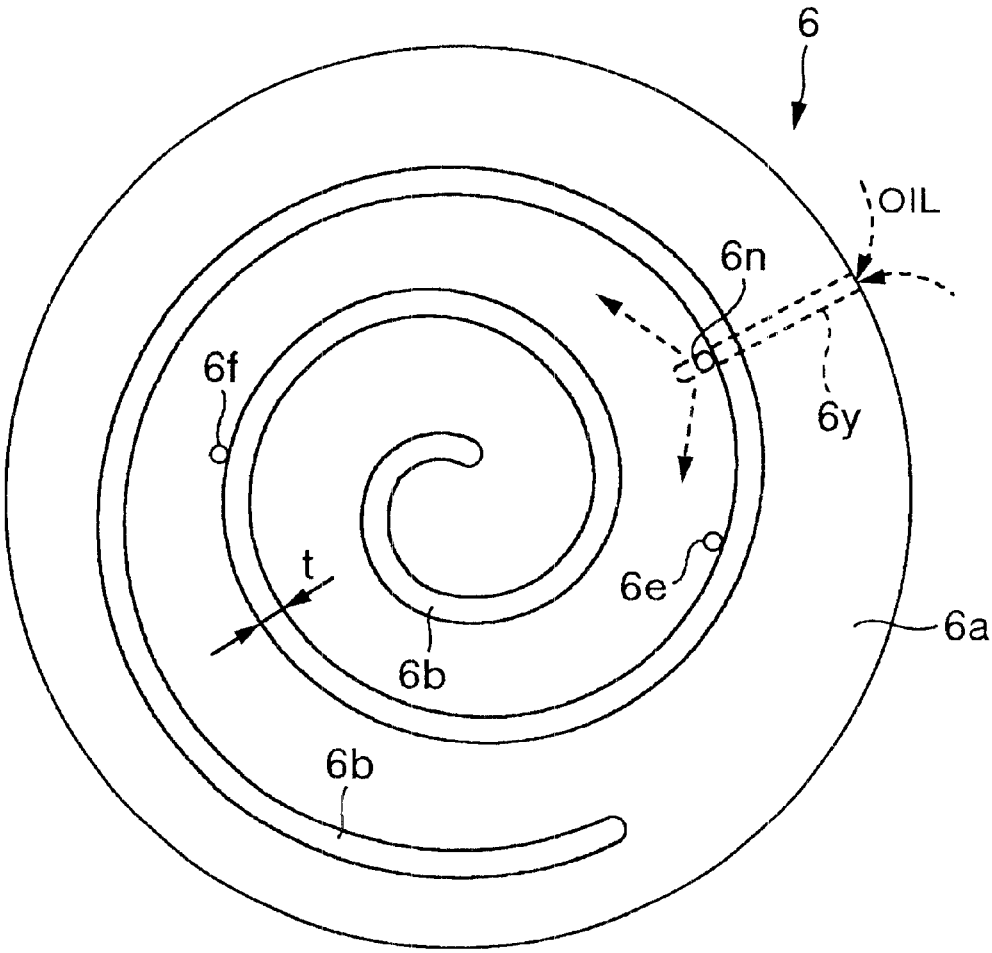
FIG. 6 is a plan view showing an orbiting scroll provided with a radial transverse hole in addition to the thin holes.
Figure 7:
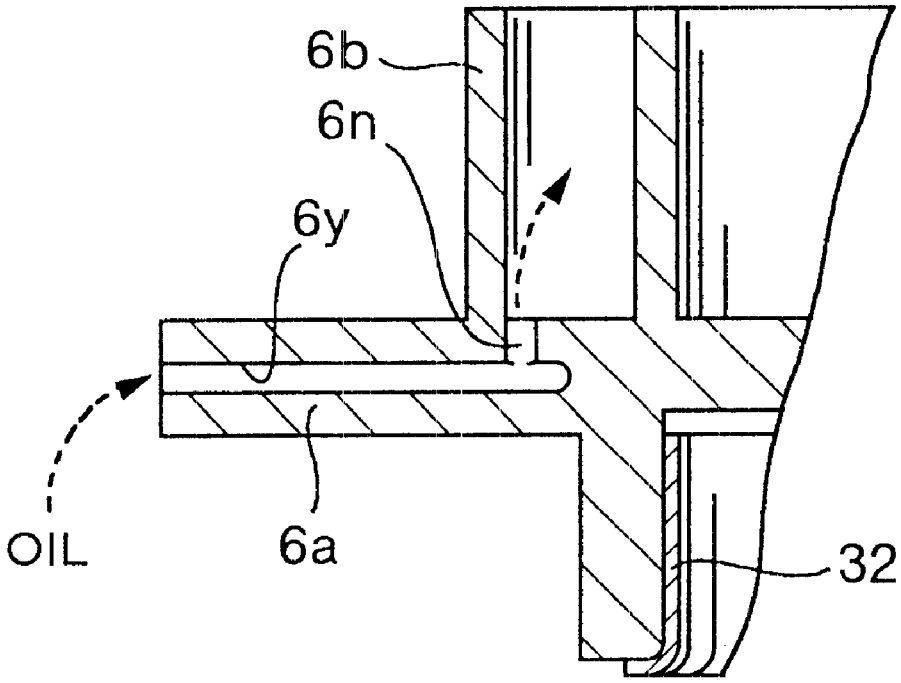
FIG. 7 is a partial vertical sectional view showing the orbiting scroll shown in FIG. 6.

FIG. 6 shows an example in which the end plate 6*a* of the orbiting scroll 6 is provided with a radial transverse hole 6*y* and a thin hole 6*n* connected thereto in addition to the thin holes 6*e* and 6*f*. FIG. 7 shows detailed structure of a portion provided with the radial transverse hole 6*y* and the thin hole 6*n*.

If such radial transverse hole 6*y* and thin hole 6*n* are provided, it is possible to positively exclude oil accumulated in an outer peripheral portion of the end plate 6*a* on the compression chamber 8 side through the radial transverse hole 6*y* and thin hole 6*n,* and to reduce oil agitation loss at the outer peripheral portion of the end plate 6*a*. In the figures, an arrow indicated by a broken line shows a flow of the oil.

Also, in the present embodiment, the back pressure Pb in the back pressure chamber 77 is set to around 1.5 times of the suction pressure Ps by means of three thin holes 6*e,* 6*f* and 6*n,* and the same effect as described above can be achieved. In order to secure a lower limit of the operating pressure ratio of, for example, 1.7, the back pressure in the back pressure chamber 77 is set to around 1.5 times of the suction pressure. This is because a pressure in difference between the discharge pressure and the back pressure (=Pd−Pb) for securing an amount of a lubrication oil into the orbiting bearing 32 and a main bearing 26 (See FIG. 12) is set to more than a certain value. In other words, in the invention, the compressor substantially satisfies the following relation:

$$(Pd/Ps)_{min} \equiv (Pb/Ps)_m + 0.2 \quad (4)$$

where $(Pd/Ps)_{min}$: lower limit of the operating pressure ratio, $(Pb/Ps)_m$: set intermediate pressure ratio.

The set intermediate pressure ratio is given as a function of positions (involute angle) of the thin holes 6*e,* 6*f* and 6*n*. Concretely, positions λb1 of the thin holes 6*e* and 6*f* become 10.8 radian (involute angle), and position λb2 of the thin hole 6*n* becomes 11.5 radian (involute angle), and an average involute angle λbm of these three holes becomes 11.03 radian. This value sets the set intermediate pressure ratio $(Pb/Ps)_m$ to 1.5 in helium application in relation to the wrap winding end angle $\lambda_1$ being 19.3 radian. The value of 0.2 in the above-described expression (4) may be extended to a range of 0.15 to 0.25 in the practical use. The set intermediate pressure ratio $(Pb/Ps)_m$ of the conventional compressor was from around 2.2 to around 2.5. That is, it is necessary to set an average involute angle λbm of the thin holes so that relation $\lambda bm/\lambda_1$ of an average involute angle λbm of the thin holes/the wrap winding end involute angle $\lambda_1$ becomes 0.55 to 0.60. In the case of the conventional compressors, the relation $\lambda bm/\lambda_1$ becomes around 0.45, and the hole position becomes closer to the discharge pressure side. Therefore, the set intermediate pressure ratio becomes higher. For this reason, in the conventional compressors, the intermediate pressure (back pressure in the back pressure chamber) becomes higher, and an axial pressing force from the orbiting scroll 6 to the fixed scroll 5 remarkably increases. By adopting the above-described scroll wrap structure of the set volume ratio Vr=2.1, increase (increase in excessive compression pressure) in the gas pressure in the compression chamber is dissolved, and the axial displacement amount of the orbiting scroll 6 becomes smaller into a stable orbiting motion. As a result, it is possible to prevent a galling phenomenon due to contact between the wraps, resulting in improved reliability of the helium compressor.

In this respect, if the scroll tooth profile shape of the wrap 6*b* is set in such a manner that the set volume ratio Vr of the scroll wrap portion becomes 1.8 to 2.3, the object of the present invention can be attained even if there are provided no thin holes 6*e* and 6*f*.

Figure 8:
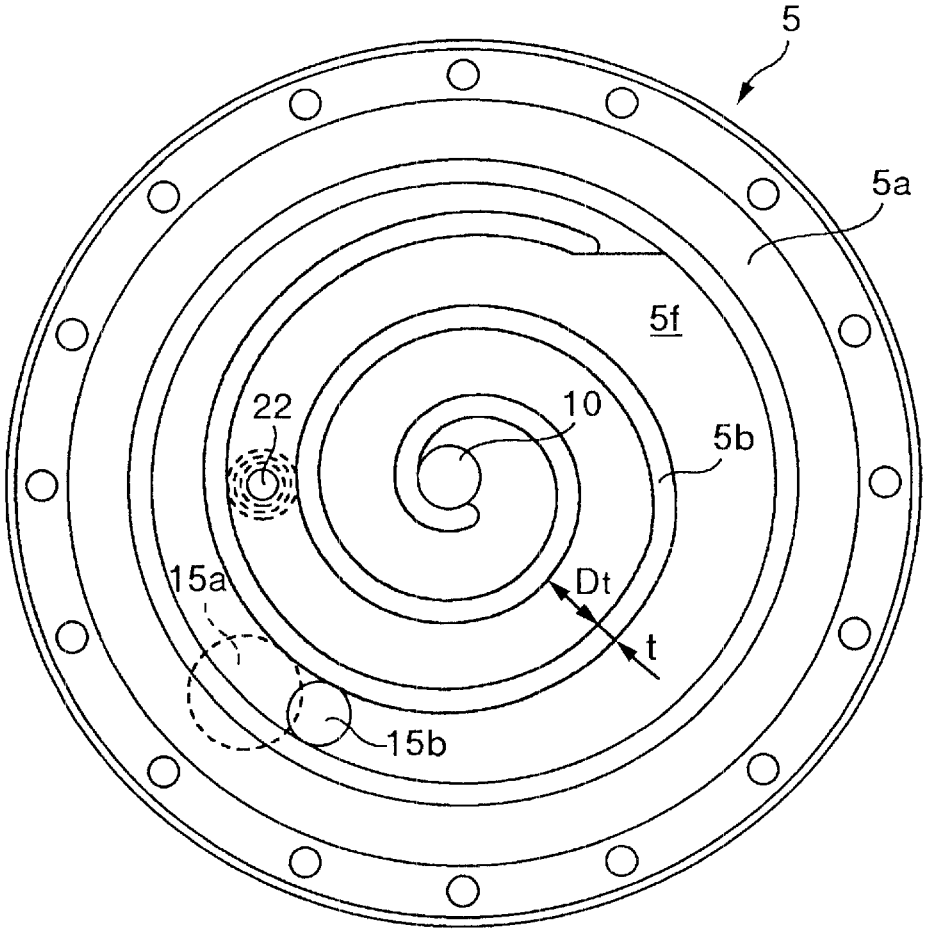
FIG. 8 is a plan view showing a fixed scroll.
Figure 9:
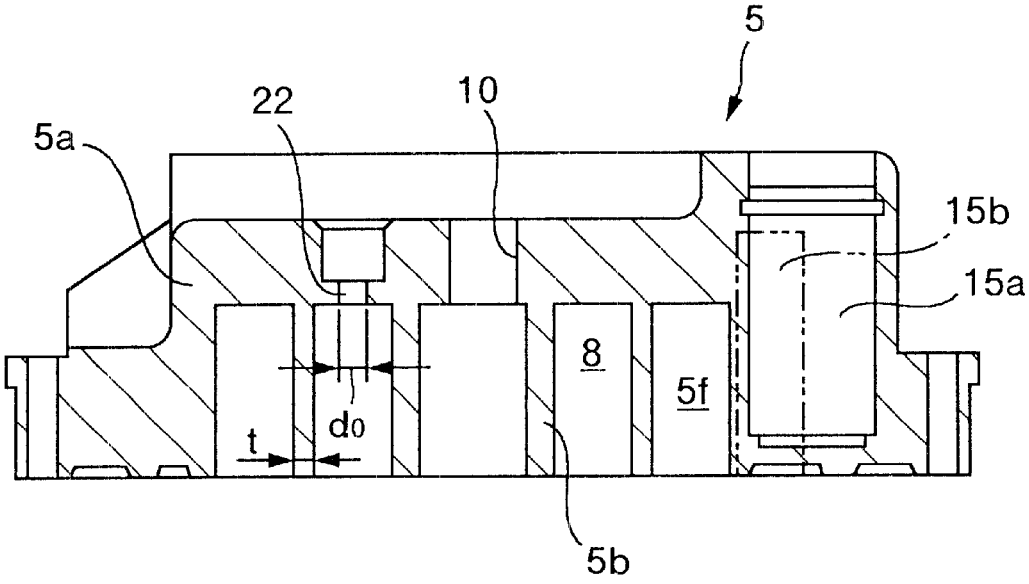
FIG. 9 is a vertical sectional view showing the fixed scroll shown in FIG. 8.

FIG. 8 is a plan view showing a fixed scroll 5, and FIG. 9 is a vertical sectional view of the fixed scroll. The fixed scroll 5 has, similarly to the orbiting scroll 6, a tip end portion formed into such a scroll tooth profile shape as shown in FIGS. 1 to 3. The fixed scroll 5 has a disk-shaped end plate 5*a,* and on the end plate 5*a,* there is formed a vortex-shaped wrap 5*b*. Also, the end plate 5*a* is provided with an oil injection port 22. The oil injection port 22 is capable of injecting cooling oil into both compression chambers 8 at the same time, and is provided at a center position of a wrap groove. A diameter (do) of the port 22 is set to a value larger than a wrap thickness t, and any oil hammer phenomenon is prevented during oil injection. Also, at a substantially central portion of the end plate 5*a,* there is provided a discharge port 10, and on an outer peripheral portion, there are provided suction ports 15*a* and 15*b*.

The scroll wrap shape shown in FIGS. 6 to 9 shows an example of the compressor having stroke capacity Vth (size of the maximum closed space) of 160 $cm^3$. Also, it is possible to set the stroke capacity Vth to 180 $cm^3$ by changing only the wrap height. In this respect, as regards compressor structure having these fixed scroll 5 and orbiting scroll 6 each having a large-sized scroll tooth profile shape, and having cooling oil injection mechanism and an oil outlet piping portion, through which the oil is supplied to the oil injection mechanism, at a base portion of the container, the description will be made with reference to FIG. 12.

Figure 10:
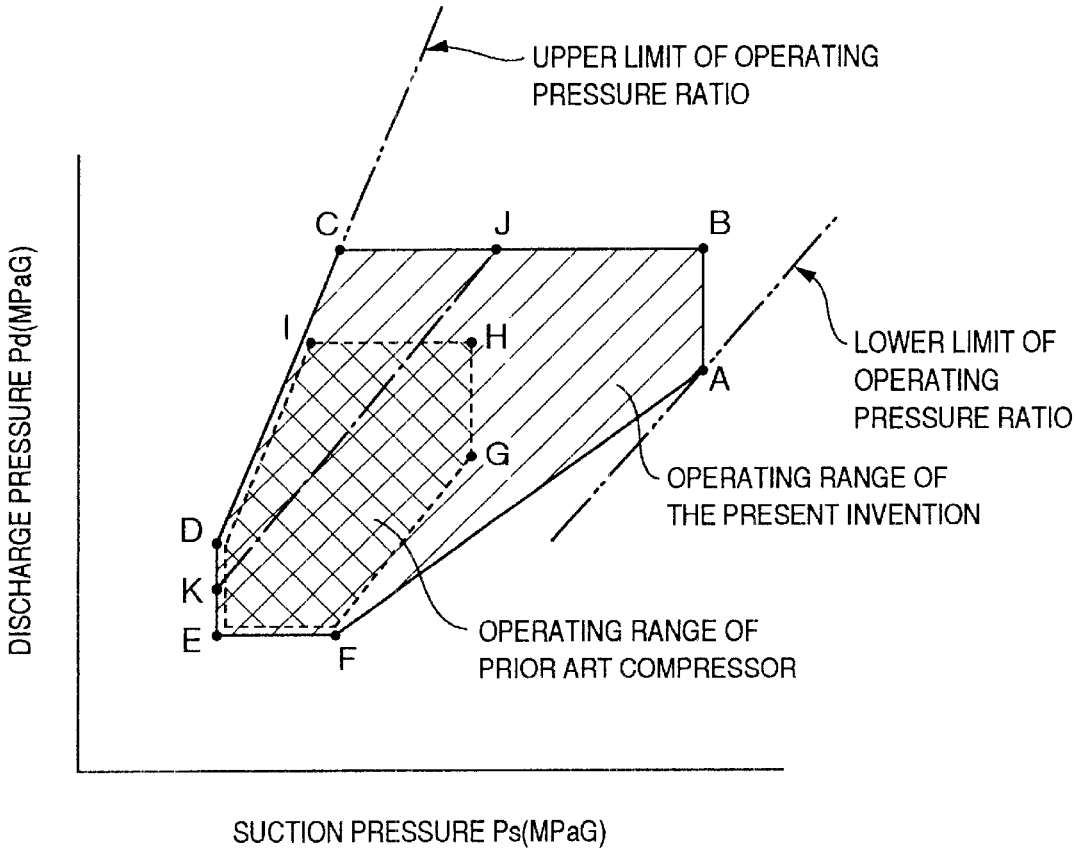
FIG. 10 is a graph showing a relationship between suction pressure and discharge pressure.
Figure 11:
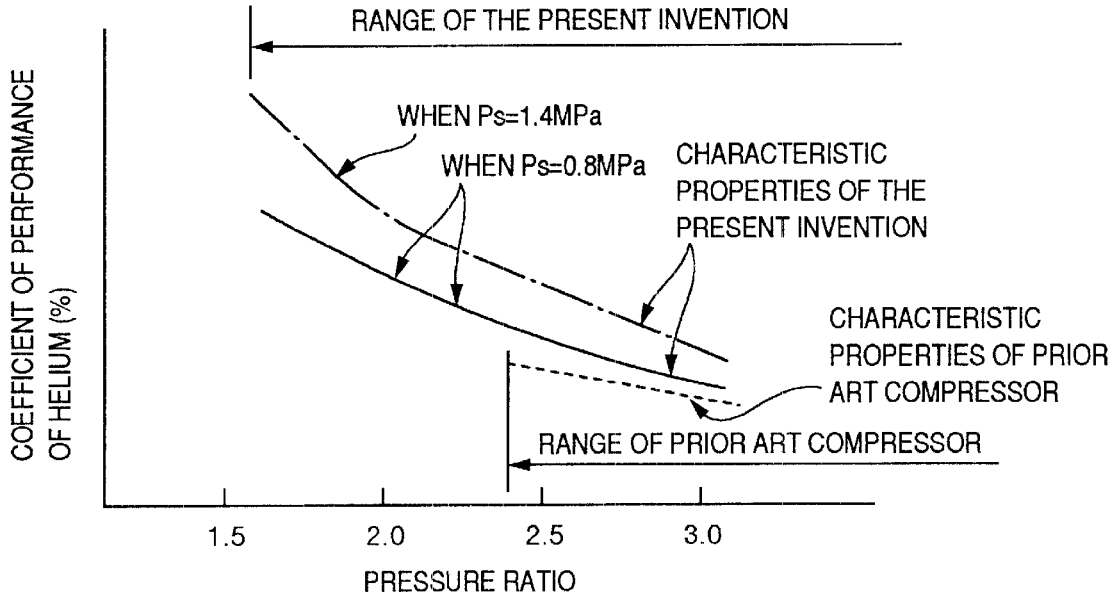
FIG. 11 is a graph showing a relationship between operating pressure ratio and coefficient of performance of helium.

FIGS. 10 and 11 are graphs showing effects of the present invention. In FIG. 10, an operating range of the present invention is an inside area of A–B–C–D–E–F–A. An operating range of the conventional compressors is an inside area of G–H–I–D–E–F–G and is a narrow pressure range. Alternatively, in the present invention, an operating range may be set to an inside area of A–B–J–K–E–F–A. A line C–D is a condition of an operating pressure ratio of around 7 while a line J–K is a condition of an operating pressure ratio of around 5. In FIG. 10, an upper limit value is set in the discharge pressure Pd. The upper limit value of the discharge pressure Pd mainly depends upon a restriction on a motor output. As the maximum value of the motor output, a value of around 190% of the rated power is set to the limit value. From this limit value, the upper limit value is set in the discharge pressure (for example, Pd=2.5 to 2.8 MPaG). Also, in the invention, an upper limit value of the suction pressure is extended to, for example, 1.5 MpaG and is set on the lower limit of the operating pressure ratio $(Pd/Ps)_{min}$, namely, around 1.5.

Figure 17:
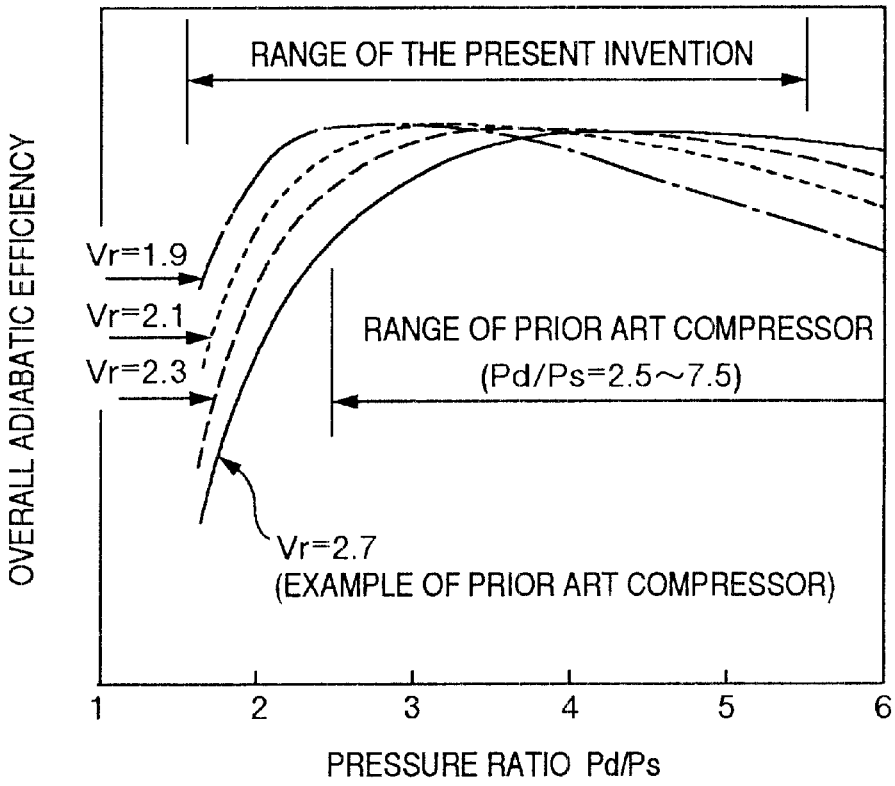
FIG. 17 is a graph showing a relationship between operating pressure ratio and overall adiabatic efficiency when set volume ratio is changed.

As shown in FIG. 11, by employing the structure according to the present invention, coefficient of performance of helium can have a character that the higher the suction pressure Ps is and the lower the operating pressure ratio is, the more coefficient of performance of helium is improved. In other words, an operation of a scroll compressor for a helium refrigerating apparatus of the invention is capable of realizing an operation in the low operating pressure ratio and the high suction pressure condition. As can be appreciated from FIG. 11, according to the present invention, by employing the above-described operating range, the coefficient of performance of helium has been greatly improved around 200% as compared with the conventional compressors. This is because, in addition to the effect of reducing the internal compression power on account of the set volume ratio Vr of the wrap portion being 2.1, a lower set intermediate pressure ratio $(Pb/Ps)_m$ has been set in the present invention than the set intermediate pressure ratio of the conventional compressors, and therefore, an axial pressing force of the orbiting scroll 6 to the fixed scroll 5 is reduced, and combined with an effect of lowered mechanical loss, an effect of application capable of further improving the performance can be obtained. As shown in FIG. 17, the scroll compressor of Vr=2.1 specification for helium application of the present invention can improve an overall adiabatic efficiency ηado several percent to ten percent in comparison with the conventional scroll compressor of Vr=2.7 specification during an operation at low operating pressure ratio. In this respect, the coefficient of performance of helium is a value defined by the following expression:

$$E=Q_N/W_i \tag{5}$$

where

E: coefficient of performance of helium ($Nm^3/h/kW$), $Q_N$: helium gas flow rate, converted at 0° C., at 1 atmospheric pressure ($Nm^3/h$), $W_i$: motor input (kW).

Next, overall structure of the scroll compressor according to the present invention is described.

FIG. 12 is a vertical sectional view of an oil injection type hermetic scroll compressor of horizontal structure. As shown in FIG. 12, the working gas is helium gas, and an oil injection pipe 31 for cooling the working helium gas is provided to penetrate a S-cap 1*a* of a hermetic container 1. The oil injection pipe 31 is connected to the oil injection port 22 provided on the end plate 5*a* of the fixed scroll 5, and an opening of the oil injection port 22 is opened to oppose tooth crest of the wrap 6*b* of the orbiting scroll 6. A scroll compressor portion 250 is contained in the hermetic container 1 at a side of a suction piping 17*a,* and an electric motor portion 3 is contained in the hermetic container 1 at the opposite side. The hermetic container 1 is partitioned into a discharge chamber 2*a* and an electric motor chamber 2*d* with the frame 11 interposed therebetween. In the scroll compressor portion 250, the fixed scroll 5 and the orbiting scroll 6 are engaged with each other to constitute compression chambers (enclosed spaces) 8.

In a central portion of the frame 11, a main bearing 26 including a cylindrical roller bearing is provided, and the main bearing 26 supports a rotating shaft 82. An eccentric shaft 82*a* is provided at a tip end of the rotating shaft 82, and the eccentric shaft 82*a* is fitted in the boss portion 6*c* of the orbiting scroll 6. Also, the fixed scroll 5 is fixed to the frame 11 through a plurality of bolts, and the orbiting scroll 6 is supported by the frame 11 through an Oldham mechanism 14 consisting of an Oldham ring and an Oldham key. When the rotating shaft 82 rotates, the orbiting scroll 6 performs an orbiting motion round the fixed scroll 5 without rotating on its own axis.

The rotating shaft 82 is integrally provided with an electric motor shaft 82*b* on the opposite side of the compressor portion 250, and the rotating shaft 82 is directly coupled to the electric motor portion 3. Suction pipes 17 (17*a* and 17*b*) penetrate the hermetic container 1 to be connected to suction ports 15 (15*a* and 15*b*) of the fixed scroll 5. A discharge chamber 2*a,* in which the discharge port 10 is opened, is communicated with the electric motor chamber 2*d* through passages 18*a* and 18*b*. The electric motor chamber 2*d* is communicated with a discharge pipe 19 penetrating a casing portion 1*b* of the central portion of the hermetic container. Also, the electric motor chamber 2*d* is communicated with a gap 20 between an electric motor stator 3*a* and a side wall of the frame 11 and a gap (not shown) between the electric motor stator 3*a* and an electric motor rotor 3*b*. In this respect, an O-ring 21*a* for sealing the high pressure portion and low pressure portion is provided between the suction pipe 17*a* and the fixed scroll 5. Also, a check valve 222 is provided in the suction pipe 17. The check valve 222 is used in order to prevent the rotating shaft 82 from being inverted while the compressor is stopped, and lubricating oil within the hermetic container 1 from flowing out on the low pressure side.

On the back surface of the end plate 6*a* of the orbiting scroll 6, there is formed a back pressure chamber 77 enclosed by the scroll compressor portion 250 and the frame 11. The intermediate pressure Pb between the suction pressure and the discharge pressure is introduced into the back pressure chamber 77 through the thin holes 6*e* and 6*f* bored on the end plate 6*a* as described above to give an axial force to press the orbiting scroll 6 against the fixed scroll 5. In a bottom portion of the hermetic container 1, lubricating oil 24 is accumulated. The lubricating oil 24 is sucked up into an oil suction pipe 96*d* by means of pressure differential between high pressure within the hermetic container 1 and the intermediate pressure Pb in the back pressure chamber 77. The lubricating oil 24 sucked up into the oil suction pipe 96*d* flows within an electric motor shaft 82*b* and within the rotating shaft 82 to be applied to the orbiting bearing 32, the main bearing 26 and an auxiliary bearing 27. The oil applied to the main bearing 26 and the orbiting bearing 32 passes through the back pressure chamber 77 to be injected into the compression chamber 8 through the thin holes 6*e* and 6*f* (See FIG. 6), and after mixed with compressed gas, is discharged into a discharge chamber 2*a* together with discharge gas.

According to the above-described structure, since differential pressure for oil supply to the main bearing 26 is secured, a cooling operation for the main bearing 26 is promoted, and the service life of the main bearing 26 can be extended substantially by a synergistic action with an effect of reduction in the bearing load resulting from improved performance of the helium compressor. In addition, the oil supply to the main bearing 26 is ensured, and reliability of the compressor can be further substantially enhanced.

In the bottom portion of the hermetic container 1, there is provided an oil fetching pipe 30 for fetching the lubricating oil 24 in the bottom portion out of the hermetic container 1. Also, at the S-cap portion 1*a* of the hermetic container 1, there is provided an oil injection pipe 31 for injecting the oil halfway in the compression stroke into the compression chambers 8 of the scroll compressor portion 250.

In the scroll compressor constructed as described above, when the motor rotor 3*b* rotates to rotate the rotating shaft 82*b*, the eccentric shaft 82*a* eccentrically rotates, and the orbiting scroll 6 performs an orbiting motion without rotating around its axis. The orbiting motion gradually moves the compression chambers 8 to the center to decrease the volume. The working gas enters a suction chamber 5*f* from the suction pipe 17 through the suction port 15 (15*a*, 15*b*: See FIG. 8). The oil, which lubricated the bearing (such as the orbiting bearing 32 and the main bearing 26), flows into the suction chamber 5*f* from a frame chamber 11*f* in the outer peripheral portion of the orbiting scroll end plate 6*a* through a minute gap between the outer peripheral portion of the orbiting scroll end plate 6*a* and the surface of the fixed scroll end plate 5*a* to mix with the working gas. The working gas including the oil, which lubricated the bearing, and the oil injected through the oil injection port 22 is compressed in the compression chambers 8, and is discharged from the discharge port 10 into the discharge chamber 2*a*. A part of the oil is separated from the gas at the discharge chamber 2*a*, and the gas passes through passages 18*a* and 18*b* to flow into the motor chamber 2*d*. In the figure, an arrow indicated in a solid line shows a flow of the working gas, and an arrow indicated in a broken line shows a flow of the oil.

The working gas and the oil, which have flowed into the motor chamber 2*d* having wide space from the thin passages 18*a* and 18*b*, abruptly lower their flow velocity and are changed in their flow direction. Therefore, greater part of the oil included in the gas is separated, and the working gas flows into the discharge pipe 19 and the oil falls down to be accumulated in the bottom portion of the hermetic container 1.

Figure 13:
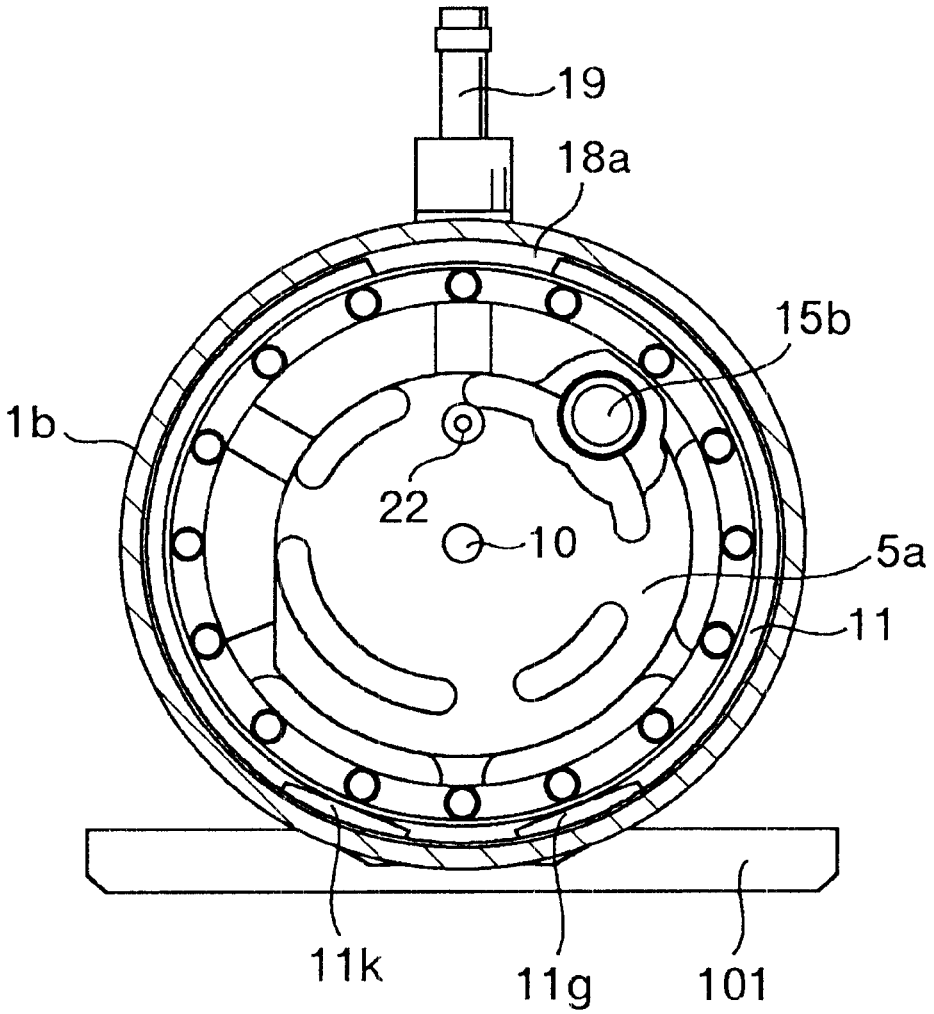
FIG. 13 is a sectional view taken along a line XIII—XIII of FIG. 12.

FIG. 13 is a sectional view taken along line XIII—XIII in FIG. 12. The oil, which has been separated from the gas at the discharge chamber 2*a* and accumulated in the bottom part, is fed into the electric motor chamber 2*d* through oil passages 11*g* and 11*k*.

Figure 14:
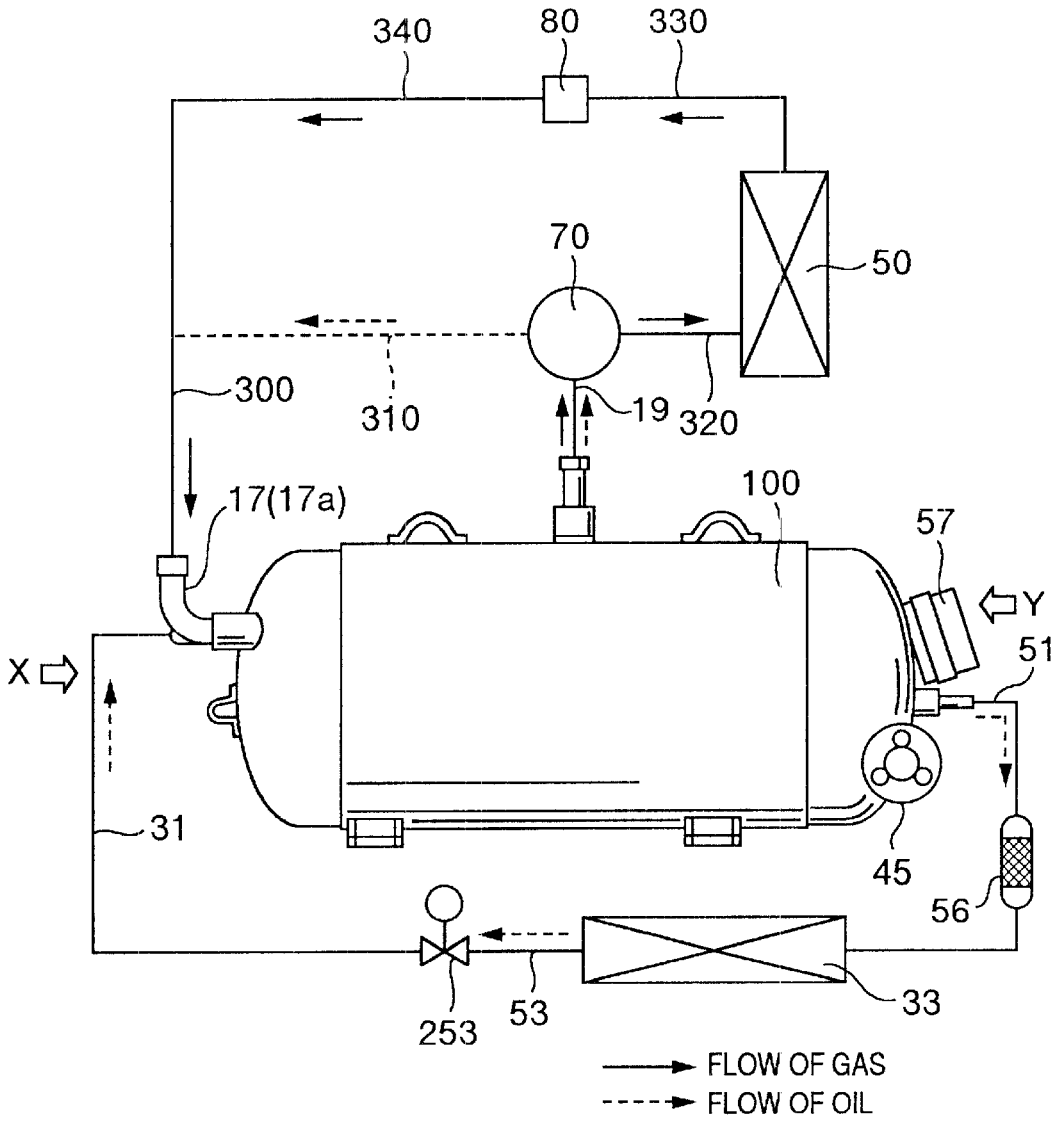
FIG. 14 is a schematic block diagram showing a helium refrigerating apparatus with the oil injection type hermetic scroll compressor of FIG. 12 installed.

FIG. 14 shows an example in which an oil injection type hermetic scroll compressor according to the present invention is applied to a helium refrigerating apparatus. As shown in FIG. 12, the lubricating oil 24 accumulated in the bottom portion of the hermetic container 1 flows into the oil fetching pipe 30 from an inflow portion 30*a* of the oil fetching pipe 30 by means of differential pressure between pressure in the hermetic container 1 (discharge pressure Pd) and pressure in the compression chambers 8 (pressure less than the discharge pressure). The oil flowed into the oil fetching pipe 30 passes through external oil piping 51 (see FIG. 14) to reach an oil strainer 56 and an oil cooler 33, where it is appropriately cooled, and thereafter, is injected into the compression chambers 8 through the oil injection pipe 53, 31 and the oil injection port 22 (See FIG. 12). A reference numeral 253 denotes an oil flow rate regulating valve.

The oil thus injected into the compression chambers 8 effects to cool the working gas and to lubricate a sliding portion of the tip end portion or the like of the scroll wraps in the compression chambers 8. Then, after compressed together with the working gas, the oil is discharged from the discharge port 10 into the discharge chamber 2*a*, and is, as has been described, separated from the working gas at the motor chamber 2*d* to be accumulated in the bottom portion of the hermetic container 1. In this respect, oil supply to each bearing 32, 26, 27 is performed through the oil suction pipe 96*d* and the oil passage within the rotating shaft 82 by means of differential pressure between pressure in the hermetic container 1 and pressure Pb in the back pressure chamber 77 (intermediate pressure).

As shown in FIG. 14, the helium gas discharged from a compressor 100 is separated from the oil at an oil separator 70 and thereafter, is cooled at a gas cooler 50. Then, the helium gas is adiabatically expanded at a helium refrigerator 80 and thereafter, is returned to the compressor 100 as suction gas through piping 340, 300 again. On the other hand, the oil in the bottom portion of the compressor 100 flows from an oil outlet piping 51 and is cooled at the oil cooler 33. Then, the oil is decompressed at an oil flow rate regulating valve 253, and thereafter the oil is injected into the compression chambers 8 halfway in compression stroke through an oil injection pipe 31 to cool the helium gas.

Figure 15:
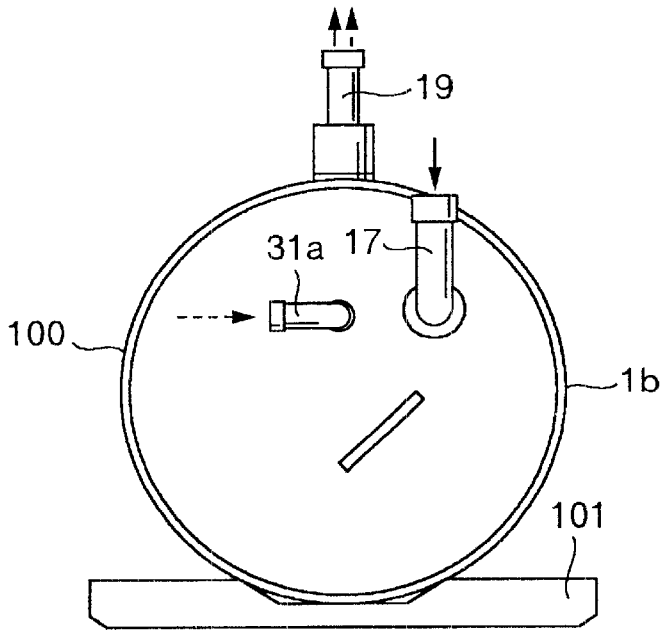
FIG. 15 is a view viewed from a direction of arrow Y in FIG. 14.
Figure 16:
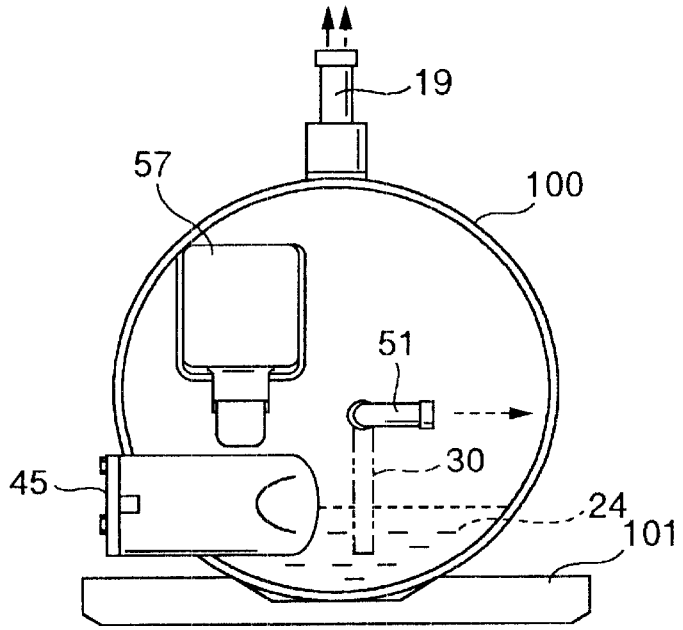
FIG. 16 is a sectional view viewed from a direction of arrow Z in FIG. 14.

FIG. 15 is a sectional view viewed from a direction of an arrow Y in FIG. 14. FIG. 16 is a sectional view viewed from a direction of an arrow Z in FIG. 14. In the figures, reference numeral 101 denotes a leg portion of the compressor; 45, an oil gauge provided to control an oil level during operation; and 57, a power supply terminal portion.

FIG. 17 is a graph showing variations in overall adiabatic efficiency with respect to the operating pressure ratio when set volume ratio Vr is changed. As can be appreciated from FIG. 17, for example, if a set volume ratio of a wrap portion Vr=1.9 specification is employed in order to realize high performance at an operating pressure ratio of 1.6, the high performance with a little change in performance is maintained over a wide range of operating pressure ratio of 1.5 to 5.0 or 5.5. For this reason, as a shape of the scroll wrap, structure having a scroll tooth profile shape of set volume ratio Vr of the wrap portion being 1.8 to 2.0 may be employed. This is obtained from a result of an experiment that even if the scroll warp is made to a scroll wrap shape of a low set volume ratio, its efficiency characteristics for the scroll compressor for helium use can keep high performance also in a high operating pressure ration condition. On the other hand, when the operating pressure ratio is over 7, torque fluctuation becomes large, causing a detrimental effect that vibration of the compressor itself is increased. For this reason, the upper limit value is provided for the operating pressure ratio.

Figure 18:
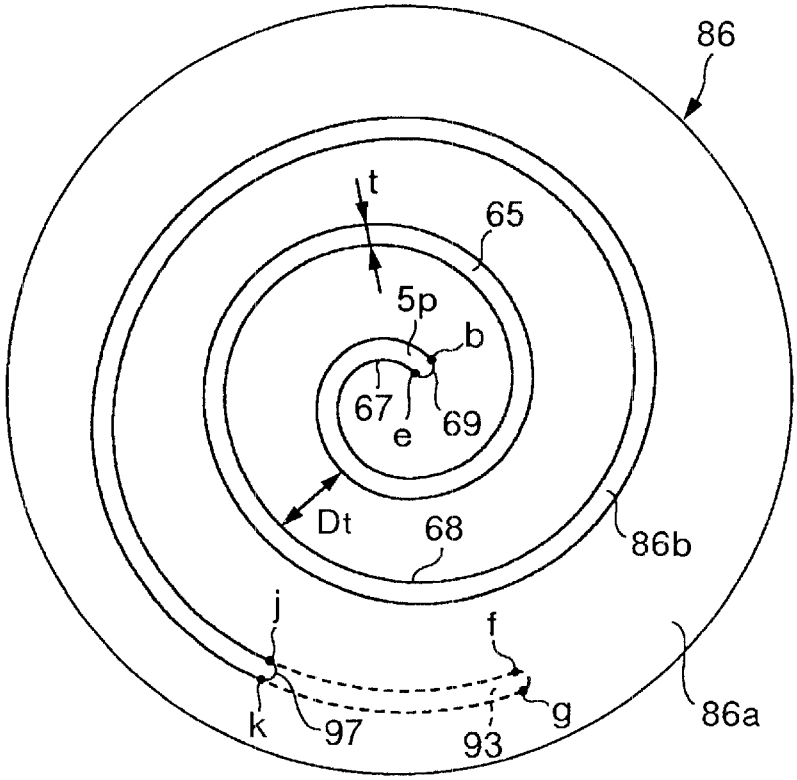
FIG. 18 is a plan view showing an orbiting scroll according to another embodiment of the invention.
Figure 19:
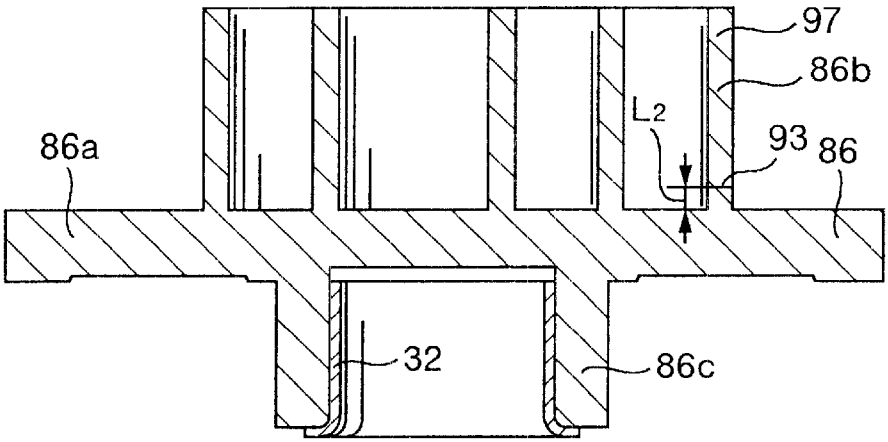
FIG. 19 is a vertical sectional view showing the orbiting scroll shown in FIG. 18.

FIGS. 18 and 19 show another embodiment according to the present invention, and FIG. 18 is a plan view of an orbiting scroll 86, and FIG. 19 is a sectional view of the orbiting scroll. A scroll wrap portion of the orbiting scroll 86 is one for air conditioner having a set volume ratio of a scroll wrap portion Vr of around 2.7 and is applied to a scroll wrap portion for helium application, and the scroll wrap portion is formed by casting material. According to the present embodiment, an upper portion of the scroll wrap winding end portion is cut leaving a portion behind, and a step 93 is provided. Thereby, the set volume ratio of the scroll wrap portion Vr is changed to 1.8 to 2.3, and an appropriate scroll wrap shape for helium application is provided.

At a tip end portion 5*p* of the scroll wrap winding start portion, point (b) is a starting point of an involute curve, and an involute angle $\lambda_s$ of the position of the point (b) becomes, for example, 1.45 radian. Points of the wrap winding end portion at points (f) and (g), which become virtual points, are shifted to point (j) and point (k), and an involute angle $\lambda_1$ of the points (j) and point (k) becomes, for example, 16.3 radian. An outside curve and an inside curve at the tip end portion of the wrap winding end portion are connected through a smooth circular arc curve 97. Also, a step 93 of the wrap winding end portion is formed L2 higher than a bottom land as shown in FIG. 19. In this respect, in the figures, a reference numeral 86*a* denotes an end plate of the orbiting scroll, and 86*b,* a wrap.

The present embodiment has an effect that a thrust gas pressure load (thrust loading force or axial pressing force) of the scroll compression portion can be reduced by a large amount as compared with the case shown in FIG. 4.

In this respect, such a step as described above can also be provided both on the scroll wrap winding start side and on the scroll wrap winding end side.

According to the present invention, the following advantages are provided:

(1) It is possible to extend a lower limit of an operating pressure ratio than the conventional operating range, and the operation can be performed on high suction pressure and low operating pressure ratio conditions, and it is possible to achieve substantial energy saving. Also, the bearing load is reduced by reduction in motor input accompanied with the enhanced performance and the service life of the bearing is also substantially improved.

(2) The reliability of the scroll compressor is substantially enhanced, and the operating pressure ratio range can be more enlarged than the conventional compressors, and the ease of use of the scroll compressor will be improved.

(3) The compressor can be made small-sized and light-weighted. Also, for the bearing portion having differential pressure oil supply structure, the oil supply can be ensured even on the low operating pressure ratio condition, and accordingly seizure accident of the bearing portion can be prevented.

In this respect, in the foregoing description, the horizontal type scroll compressor for helium application has been exemplified, but the present invention mainly relates to the shape of the scroll wrap, and is also applicable to a vertical type scroll compressor for helium application, which is within the scope of the present invention.

As described above, according to the present invention, it is possible to provide a scroll compressor capable of ensuring a stable operation without degrading the efficiency even in an exceedingly low operating pressure ratio area.

Further, the scroll compressor is capable of satisfying requests such as an increase in an helium gas circulating amount and an increase in capacity as a scroll compressor for helium application by enlarging the service operating pressure range and further securing an operation on the high suction pressure condition.

What is claimed is:

1. A scroll compressor for use in a helium refrigerating apparatus, comprising:

a fixed scroll and an orbiting scroll engaged with each other, wherein an operating pressure range in which an operating pressure ratio which is a ratio of a discharge pressure to a suction pressure is around 1.5 to around 5 and an upper limit value of the suction pressure is set on a lower limit value of the operating pressure ratio, and wherein said fixed scroll is fixed to a frame provided on a back side of said orbiting scroll to form a back pressure chamber by said frame and a back surface of an end plate of said orbiting scroll; and an oil filler port, through which oil for cooling said helium gas is injected into compression chambers formed by said fixed scroll and said orbiting scroll is provided on end plate of said fixed scroll;

a thin hole, through which a part of the helium gas halfway in compression stroke in the compression chambers is introduced into said back pressure chamber is formed on said end plate of said orbiting scroll; and a ratio Pb/Ps of pressure Pb in said back pressure chamber to suction pressure Ps is set to around 1.5.

2. A scroll compressor using helium gas as working gas, comprising:

a fixed scroll and an orbiting scroll, engaged with each other, each having a scroll tooth profile shape of a set volume ratio of a scroll wrap portion of 1.8 to 2.3, said set volume ratio of a scroll wrap portion being defined by the following expression:

$$Vr = \frac{2\lambda_1 - 4\pi + \alpha}{2\lambda_s + 2\pi + \alpha}$$

where Vr: set volume ratio of a scroll wrap portion, $\lambda_1$: an angle at a wrap winding end portion (Involute angle), $\lambda_s$: an angle at a wrap winding start portion (Involute angle), $\pi$: circle ratio, $\alpha$: ratio of an orbiting radius ($\epsilon_{th}$) to a base circle radius (a) of the scroll wrap ($\epsilon_{th}$/a), and wherein said fixed scroll is fixed to a frame provided on a back side of said orbiting scroll to form a back pressure chamber by said frame and a back surface of an end plate of said orbiting scroll; and an oil filler port, through which oil for cooling said helium gas is injected into compression chambers formed by said fixed scroll and said orbiting scroll is provided on an end plate of said fixed scroll;

a thin hole, through which a part of the helium gas halfway in compression stroke in the compression chambers is introduced into said back pressure chamber is formed on said end plate of said orbiting scroll; and a ratio Pb/Ps of pressure Pb in said back pressure chamber to suction pressure Ps is set to around 1.5.

3. The scroll compressor according to claim 2, wherein said scroll wrap portion is formed of casting material, and at least one of a scroll wrap winding start portion and a scroll wrap winding end portion is provided with a step.

4. The scroll compressor according to claim 1, wherein a lower limit of an operating pressure ratio and a set intermediate pressure ratio substantially satisfy the following relation:

$$(Pd/Ps)_{min} \cong ((Pb/Ps)_m + 0.2.$$

where Pd: discharge pressure,

Ps: suction pressure,

Pb: back pressure, $(Pd/Ps)_{min}$: lower limit of an operating pressure ratio, $(Pb/Ps)_m$: set intermediate pressure ratio.

5. The scroll compressor according to claim 2, wherein said set volume ratio of said scroll wrap portion is 2.1.

6. The scroll compressor according to claim 5, wherein tip ends of said scroll wrap portion are rounded with a radius larger than a half of an average thickness of said scroll wrap portion.

7. A scroll compressor using helium gas as working gas, comprising:

a fixed scroll and an orbiting scroll, engaged with each other, each having a scroll tooth profile shape of a set volume ratio of the scroll wrap portion of 1.8 to 2.0, said set volume ratio of the scroll wrap portion being defined by the following expression, wherein an operating pressure ratio of said compressor is in a range of around 1.5 to around 5:

$$Vr = \frac{2\lambda_1 - 4\pi + \alpha}{2\lambda_s + 2\pi + \alpha}$$

where Vr: set volume ratio of a scroll wrap portion, $\lambda_1$: an angle at a wrap winding end portion (Involute angle), $\lambda_s$: an angle at a wrap winding start portion (Involute angle), $\pi$: circle ratio, $\alpha$: ratio of an orbiting radius ($\epsilon_{th}$) to a base circle radius (a) of the scroll wrap ($\epsilon_{th}$/a), and wherein said fixed scroll is fixed to a frame provided on a back side of said orbiting scroll to form a back pressure chamber by said frame and a back surface of an end plate of said orbiting scroll; and an oil filler port, through which oil for cooling said helium gas is injected into compression chambers formed by said fixed scroll and said orbiting scroll is provided on an end plate of said fixed scroll;

a thin hole, through which a part of the helium gas halfway in compression stroke in the compression chambers is introduced into said back pressure chamber is formed on said end plate of said orbiting scroll; and a ratio Pb/Ps of pressure Pb in said back pressure chamber to suction pressure Ps is set to around 1.5.

* * * * *